US007690158B2

(12) United States Patent
Kelly

(10) Patent No.: US 7,690,158 B2
(45) Date of Patent: Apr. 6, 2010

(54) SIGHT AND SOUND BARRIER

(75) Inventor: Ray G. Kelly, St. Louis, MO (US)

(73) Assignee: Angeles Corporation, Pacific, MO (US)

( * ) Notice: Subject to any disclaimer, the term of this patent is extended or adjusted under 35 U.S.C. 154(b) by 857 days.

(21) Appl. No.: 10/961,617

(22) Filed: Oct. 8, 2004

(65) Prior Publication Data

US 2005/0076585 A1 Apr. 14, 2005

Related U.S. Application Data

(60) Provisional application No. 60/510,026, filed on Oct. 9, 2003.

(51) Int. Cl.
*E04B 1/346* (2006.01)
*E04B 1/82* (2006.01)
*E04C 1/00* (2006.01)
*E04C 2/34* (2006.01)

(52) U.S. Cl. ..... 52/145; 52/71; 52/309.8; 52/794.1; 181/291

(58) Field of Classification Search ..... 52/71, 52/144, 145, 309.7, 309.8, 794.1, 631, DIG. 4, 52/13; 160/135, 230, DIG. 16; 181/287, 181/291; 5/420, 722; 40/605
See application file for complete search history.

(56) References Cited

U.S. PATENT DOCUMENTS 681,573 A * 8/1901 Nochols ..... 5/722
1,671,084 A * 5/1928 Meyercord ..... 52/631
1,711,471 A * 4/1929 Curran ..... 52/631
2,738,834 A * 3/1956 Jaffe et al. ..... 5/420
2,857,957 A * 10/1958 Gay ..... 297/114
3,192,099 A * 6/1965 Foyster et al. ..... 428/71
3,212,529 A * 10/1965 Ullman et al. ..... 138/141
3,251,382 A * 5/1966 Tatsch ..... 138/151
3,416,282 A * 12/1968 Daugherty ..... 52/716.8
3,649,398 A * 3/1972 Keith ..... 156/79
3,731,449 A * 5/1973 Kephart, Jr. ..... 52/631
3,911,554 A * 10/1975 Ford ..... 29/527.2
4,028,855 A * 6/1977 Prewer ..... 52/272
4,118,903 A * 10/1978 Coulthard ..... 160/351
4,275,473 A * 6/1981 Poirier ..... 441/128
4,480,715 A * 11/1984 Brooks ..... 181/287
4,654,907 A * 4/1987 Haugaard ..... 5/420
4,662,851 A * 5/1987 Foster ..... 441/129
4,704,837 A * 11/1987 Menchetti et al. ..... 52/631

(Continued)

FOREIGN PATENT DOCUMENTS

EP 0 437 999 A2 * 7/1991

(Continued)

*Primary Examiner*—Richard E Chilcot, Jr.
*Assistant Examiner*—Ryan D Kwiecinski
(74) *Attorney, Agent, or Firm*—Woodard, Emhardt, Moriarty, McNett & Henry LLP

(57) ABSTRACT

In one embodiment, the sight and sound barriers of this invention have a flexible sheet of lightweight, resilient foam as a core. This core is covered by a fabric or other suitable covering to further enhance the acoustic properties and to make the walls attractive. In this embodiment the core of polyethylene, polystyrene, urethane, or a mosaic thereof, for example, is made flexible with alternating wall and hinge portions. In an alternate preferred embodiment, the barriers or panels are formed with mitered grooves to allow the panel to be bent into larger degree corners, such as 90 degrees in one direction or 180 degrees in the opposite direction.

26 Claims, 8 Drawing Sheets

U.S. PATENT DOCUMENTS

| | | | | | |
|---|---|---|---|---|---|
| 4,711,046 | A | * | 12/1987 | Herrgord | 40/605 |
| 4,726,155 | A | * | 2/1988 | Nahmias | 52/71 |
| 4,768,748 | A | * | 9/1988 | Leimkuhler et al. | 249/192 |
| 5,024,015 | A | * | 6/1991 | Quarles, Jr. | 40/605 |
| 5,265,292 | A | * | 11/1993 | Underell | 5/419 |
| 5,439,043 | A | * | 8/1995 | Carter | 160/135 |
| 5,515,900 | A | * | 5/1996 | West et al. | 160/135 |
| 5,560,413 | A | * | 10/1996 | Brown | 160/135 |
| 5,611,384 | A | * | 3/1997 | Carter | 160/135 |
| 5,669,089 | A | * | 9/1997 | Dees | 5/419 |
| 5,843,353 | A | * | 12/1998 | De Vos et al. | 264/102 |
| 5,918,644 | A | * | 7/1999 | Haack et al. | 138/151 |
| 6,618,883 | B2 | * | 9/2003 | Angland | 5/659 |
| 6,711,766 | B2 | * | 3/2004 | Monk et al. | 5/420 |
| 7,036,162 | B1 | * | 5/2006 | Gatten | 5/421 |
| 2003/0221256 | A1 | * | 12/2003 | Monk et al. | 5/420 |
| 2004/0134162 | A1 | * | 7/2004 | Douglas | 52/741.1 |
| 2007/0209305 | A1 | * | 9/2007 | Douglas | 52/300 |

FOREIGN PATENT DOCUMENTS

| | | | |
|---|---|---|---|
| GB | 2 010 178 A | * | 6/1979 |
| GB | 2 182 556 A | * | 5/1987 |
| JP | 63-15732 | * | 1/1988 |

* cited by examiner

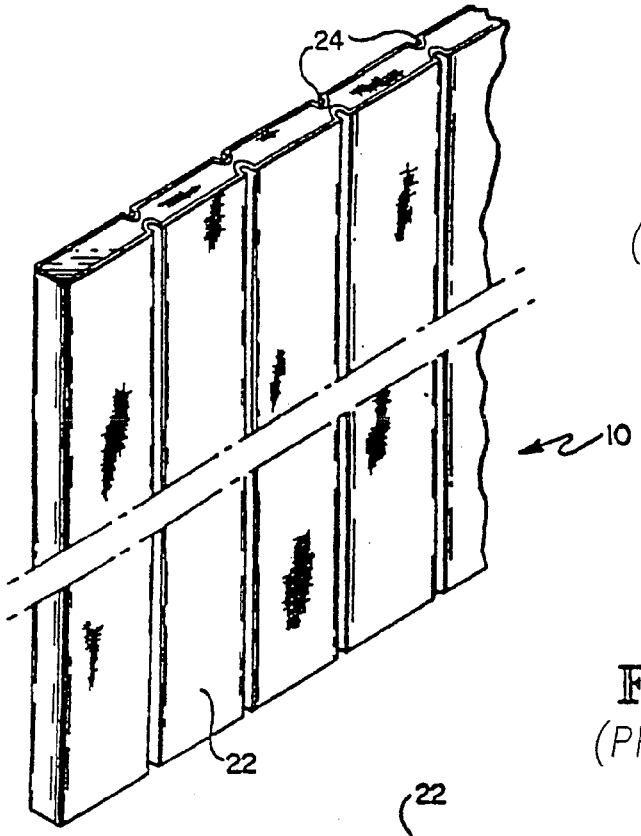
FIG. 1
(PRIOR ART)
FIG. 2
(PRIOR ART)
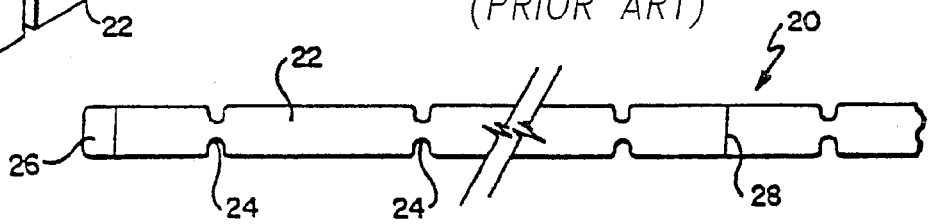
FIG. 3 (PRIOR ART)
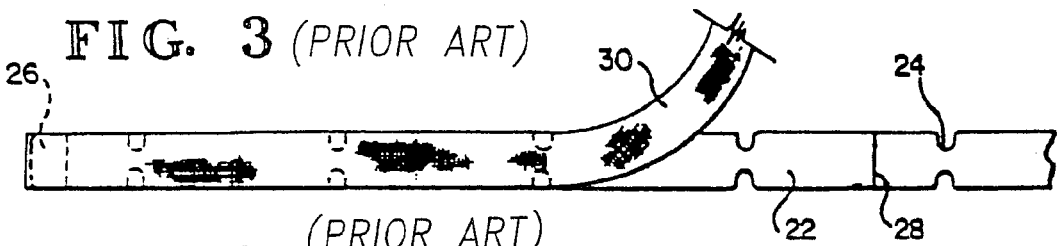
(PRIOR ART)
FIG. 4
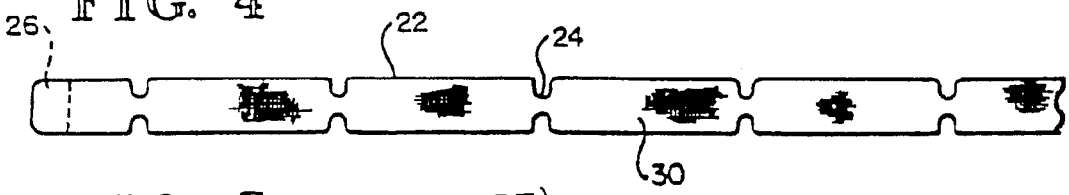
FIG. 5 (PRIOR ART)
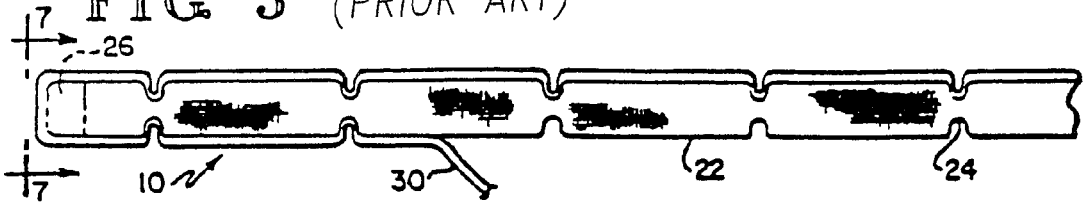

SIGHT AND SOUND BARRIER

The present application claims priority to provisional application Ser. No. 60/510,026, filed Oct. 9, 2003, which is incorporated herein by reference.

FIELD OF THE INVENTION

This invention relates to portable, free-standing walls which, among other uses, function as sight and sound barriers. More particularly, this invention relates to barriers and panels with a foam core and a covering material.

BACKGROUND OF THE INVENTION

There is often a need for subdividing a room or open space into smaller areas permanently or for a short period of time. Temporary walls may be erected, but to do so is expensive. Room dividers or screens of wood or rattan may be used, but they often fail to function as effective sound barriers, and may be difficult to handle and store.

One version of a prior barrier is illustrated in U.S. Pat. No. 4,480,715.

There is a need for improved barriers and panels.

SUMMARY OF THE INVENTION

This invention addresses several problems of the prior art by introducing an improved versatile, durable, inexpensive, attractive, portable, free-standing sight and sound barrier wall or panels which have potential other uses such, for example, as a crash pad on gymnasium walls, a decorative panel, a privacy barrier in restaurants, study carrel dividers, a display backdrop and traffic delineator for exhibitions, a sleeping pad, or a tumbling mat. Within minutes, the wall may be erected to subdivide rooms into smaller work or play areas. The wall may be rolled or folded into a compact unit for storage or may be stored upright against existing walls for improved room acoustics.

In one embodiment, the sight and sound barriers of this invention have a flexible sheet of lightweight, resilient foam as a core. This core is covered by a fabric or other suitable covering to further enhance the acoustic properties and to make the walls attractive. In this embodiment the core of polyethylene, polystyrene, urethane, or a mosaic thereof, for example, is made flexible with alternating wall and hinge portions. The foam is preferably resilient so that pressure marks are temporary. When dented, the foam preferably recovers in a few hours. Being resilient allows more permanent adherence of the fabric to the core because the core will tend to compress on bending, while it recovers when the barrier is straightened. Thus the core and fabric act as one piece rather than two. Loosening of the adhesive between them, especially at the hinges, is reduced.

When made of a core of polyethylene foam and a polypropylene fabric cover, the sight and sound barriers of this invention are preferably extremely light, for example weighing about 10 ounces per square foot. The barriers are nearly indestructible, resisting staining and puncturing. They are available in virtually any height or length so that they are suitable for almost any need. Needing no hardware to use, they are easy to install, attractive, and extremely versatile.

In an alternate preferred embodiment, the barriers or panels are formed with mitered grooves to allow the panel to be bent into larger degree corners, such as 90 degrees in one direction or 180 degrees in the opposite direction. Preferably the grooves have a depth extending substantially through the thickness of the core. In one embodiment, the covering material on one side of the panel is laid into the groove so that the covering material of a wall portion approaches, or preferably touches, the covering material on the opposite side. In an optional feature, grooves can be placed on alternating sides of the panel or barrier.

In an optional feature, groove inserts may be sized and shaped to be placed in the grooves. The groove inserts may include a face which is flush with, recessed or protrudes from the adjacent wall portions. The groove inserts and mitered grooves may use various connectors such as Velcro® hook and loop fasteners or magnets.

It is an object of certain embodiments of the present invention to provide an improved sight and sound barrier.

Other objects of the embodiments of the present invention are apparent from the description, figures and claims herein.

BRIEF DESCRIPTION OF THE DRAWINGS

FIG. 1 is an isometric view of a sight and sound barrier.

FIG. 2 is an end elevation of a core for the sight and sound barrier.

FIG. 3 is a view similar to FIG. 2, showing attachment of fabric to the end.

FIG. 4 is another view similar to FIG. 2, showing trimmed fabric adhered to the end.

FIG. 5 is another view similar to FIG. 2, showing attachment of fabric to the sides of the core.

DESCRIPTION OF PREFERRED EMBODIMENTS

Figure 6:
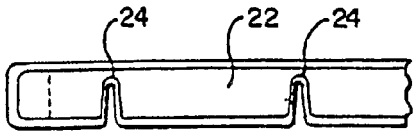
FIG. 6 (PRIOR ART)
FIG. 6 is an end elevation of an alternate barrier.
Figure 7:
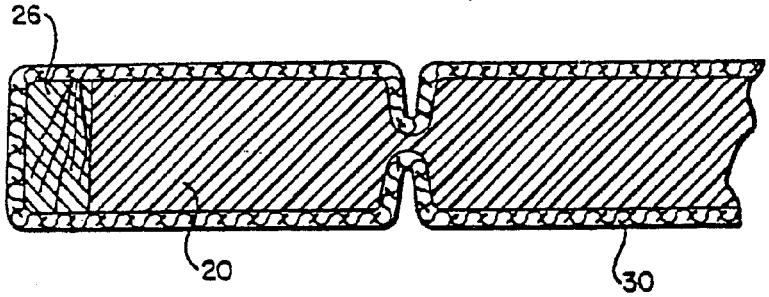
FIG. 7 (PRIOR ART)
FIG. 7 is a detailed section of a sight and sound barrier.

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

One embodiment of the sight and sound barrier of this invention has a core 20 of lightweight, resilient foam and a covering 30 adhered about all the sides of the core 20. The core 20 is flexible because it has alternating wall 22 and hinge 24 portions. The hinge portions 24 are thinner sections of the foam and are generally made by routing grooves out of a uniformly thick sheet of foam. However, the foam can be otherwise formed with the grooves.

Many materials may be used to make these barriers 10. As examples, the foam for the core may be selected from the group consisting of polyethylenes, polystyrenes, and urethanes. Ethaform 220, a trademarked product of the Dow Chemical Co., is a particularly desirable foam. The covering may be a fabric, foil or paper product or a painted-on material. However, a covering with good acoustical properties is preferred. All types of decorative fabrics may be used, although polypropylene berberib material has been found to be particularly desirable, in which case 3M's adhesive glue #4693 is preferred. However, other suitable adhesives may be used as well.

The following discussion will focus upon construction of preferred sight and sound barriers made from polyethylene foam and a polypropylene fabric covering. A typical thickness and height will be used for purposes of example only.

To make a 2-inch thick, 60-inch high wall, a piece of raw foam is cut to provide a reference edge. The foam is then cut to form 36-inch by 61-inch sheets. On each side of the sheets, grooves are plowed. Each groove has tapered sides and a ⅝-inch radius at the bottom. The grooves begin 3 inches on center from the edge of each sheet, are 6 inches apart, and run the length of the sheet. Once plowed, the grooves provide a thinned hinge portion 24 having a thickness of about ⅜ to ½-inch. As an alternative to grooves on both sides, a single deep groove may be made on one side of the foam to form a hinge (FIG. 6).

For a panel with a longer width, the edges of the sheets are sprayed with an adhesive to develop a heavy build, and the foam sheet edges are adhered together to form a panel, squeezing along the seam 28 until well bonded. End caps 26 may be added to close the first and last wall portions 22 which may be six inches long. The end caps 26 usually are foam, but a wood strip may be used if the wall is to be tracked to a building structure for additional support.

Once glued together, the edges of each groove are routed, for example with a ⅜-inch radius, and the top and bottom ends are trimmed with a straight edge and skill saw to an overall height of 59½ inches. A heavy build of adhesive (about four coats from a Binks 66SS fluid nozzle/66S D cap at 25 psi air and 45 psi fluid pressure at about 70.degree. F.) is sprayed onto the ends and let dry. Optionally, the sides of the panel are perforated with ⅝-inch deep, 3/32-inch diameter perforations using a saber saw with a custom 24-point perforator block. These perforations improve the acoustic properties of the foam and enhance its resiliency when covered.

Four coats of adhesive are also placed on 2½ inch wide strips of fabric (FIG. 3). When nearly dry, each strip is applied to a top or bottom edge of the panel with one edge of the strip flush with one face of the panel. The other edge of the fabric strip is then trimmed to be flush with the other panel face. Each groove is trimmed so that the fabric is flush with the foam surface (FIG. 4).

Fabric for the panel faces is cut, leaving about a 2-inch overlap for the top and bottom (roughly a 64-inch wide sheet for making this 60-inch panel). The fabric is then rolled with the good side in, preparatory to its application. At the fourth groove from an end of the panel, adhesive is sprayed over that wall portion to provide a heavy build. Adhesive is also sprayed onto the first 10 inches of fabric. The fabric is then adhered to the first glued wall portion with hand pressure, allowing two to three minutes to dry. The next wall portion and fabric portion are sprayed with two slow (yet heavy) passes of the spray gun. While still slippery with the adhesive, the fabric is pressed into the groove and pressed with a wood straight-edge mold to insure its contact over the entire length of the groove. A coaster wheel is run along the length of the groove with about 25-40 pounds of pressure to insure contact of the fabric with the glued foam. If the fabric is ribbed, care should be taken to keep the ribs parallel to the grooves. Gluing continues as just described for each wall and hinge portion.

At the end of the fabric roll, a straight edge is cut and the fabric glued to the middle of a wall portion. A new fabric roll is prepared. Gluing begins on the next uncovered wall portion, leaving sufficient fabric to form a seam later. A seam is formed by overlapping the two fabric ends and cutting through both pieces at once. After removing the trim piece from beneath and applying the adhesive (if necessary), the trimmed ends are pressed into place. The method of seaming together the fabric portions is also used in covering the three panels initially skipped.

With the fabric glued over both faces and both edges of the panel, the overlap at the top and bottom ends is trimmed at about a 60 degree angle to the ends. To insure a bond, the trimmed fabric edges are pressed together. Fabric fuzz is trimmed to make the sight and sound barrier ready for final drying. About one-half hour is required to insure proper drying. Once dried, the barrier may be rolled into a circle or folded into a stack (the hinges will dictate the smallest radius possible) and wrapped in plastic for storage. Air may be blown over the faces to remove dust and other debris from the fabric.

The barrier need not be made of one type of foam or of one type of covering only. A mosaic of foams may be used, such as alternating sections of polyethylene and polystyrene glued together. The faces of the panels may be covered with different coverings; one face may have a mosaic.

Figure 8:
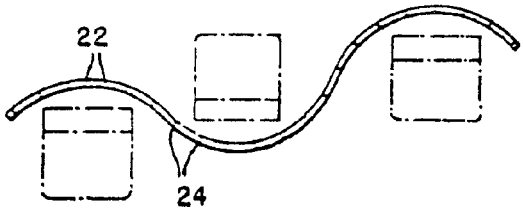
FIG. 8 (PRIOR ART)
FIG. 8 is a schematic top plan of a sight and sound barrier in a free-standing, zig-zag arrangement.
Figure 9:
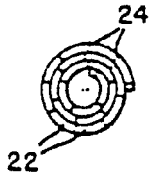
FIG. 9 (PRIOR ART)
FIG. 9 is a schematic top plan of a sight and sound barrier rolled for storage.

Thus the sight and sound barrier 10 of this invention has alternating wall 22 and hinge 24 portions of a lightweight, resilient foam core 20 and a covering 30 adhered around all exposed sides. The hinge portions 24 allow the barrier 10 to be bent so that it can free-stand by being placed in a zig-zag arrangement or smooth curve (as shown in FIG. 8) and can be rolled for storage (as shown in FIG. 9). The fabric facing in the hinge portions of the foam helps to strengthen the hinge. The foam core 20 compresses on bending so that the adhesive seal between the core 20 and covering 30 is not broken. When the barrier 10 is straightened, the foam core 20 returns to its original shape. This resiliency makes the barrier 10 useful for many activities other than acoustical soundproofing.

In a different and improved preferred embodiment, barrier 100 includes one or more wall segments 110. A wall segment 110 includes an inner core 120 with an outer covering 130. Wall segments may be of various widths as desired. Typically core 120 is a resilient foam material and covering 130 is a fabric. Covering 130 can be adhered to core 120 as described herein. Covering 130 may be decorated in desired colors, textures, patterns or murals.

Figure 10:
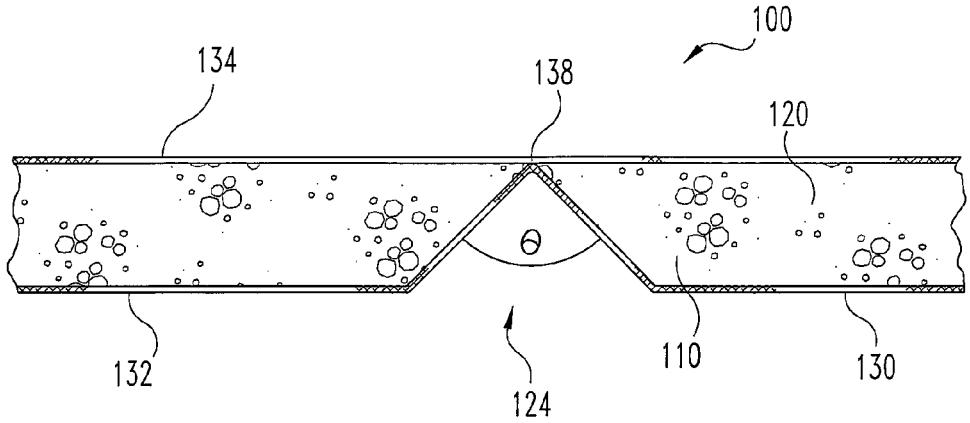
FIG. 10 is a top plan view of a barrier portion according to an alternate preferred embodiment of the present invention.
Figure 11:
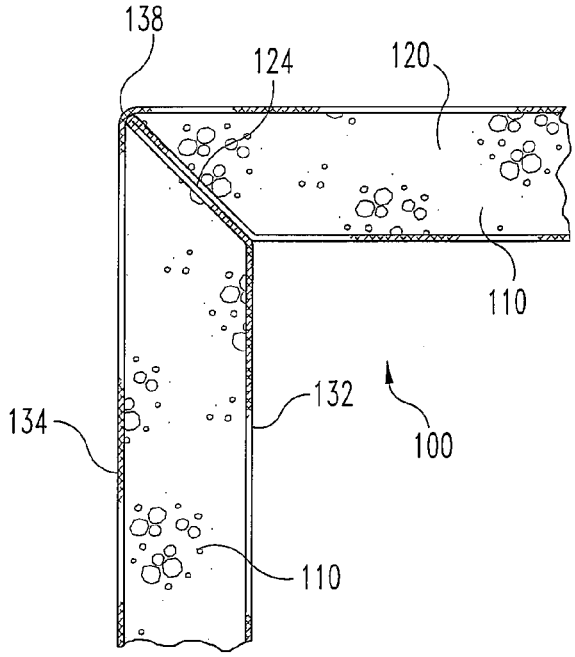
FIG. 11 is a top view of the barrier portion of FIG. 10 in a corner arrangement.

Barrier 100 is illustrated in FIG. 10 with wall segments 110 alternating with at least one groove 124. Preferably groove 124 is formed with mitered side edges to wall segments 110 to enable barrier 100 to be bent, preferably at a 90° angle in one direction (FIG. 11). By way of example, the grooves can be made with a router. In one preferred embodiment, groove 124 includes a mitered radius Θ of 90° allowing a right-angled corner. Groove 124 may have a depth substantially equal to the width of barrier 100. Preferably covering 130 has a first side 132 on one side of the barrier and a second side 134 on the second side of the barrier on either side of core 120. The first side material 132 is preferably mounted along the face of the wall portions and into the complete depth of groove 124 such that first side 132 touches or substantially approaches the cover on opposing side 134 at junction 138 defined in a wall portion of the second side of the barrier.

In this embodiment, preferably core 120 does not extend substantially through junction 138, forming discrete wall segments. The reduction or elimination of core material through junction 138 allows bending of barrier 100 without breaking or repeated bending of the foam. In one preferred feature, the materials injunction 138 include elastic qualities to avoid stretch marks after the barrier is bent repeatedly. Barrier 100 may be held in a bent or corner configuration (FIG. 11) by brackets, clips, hooks, magnets, Velcro® fasteners or by other methods. The ends of the barriers may be plain, or may be connectable with Velcro® fasteners, magnets, wood strips, screws or other fasteners.

In a preferred feature, grooves 124 have a mitered shape, allowing the barrier to form a right-angled corner in one direction. The miter may be a forty-five degree cut on each section, or different angles preferably complementary to form a total angle Θ of approximately 90°. The groove may also allow a turn range from 0° to 180° in the alternate direction, providing a total of 270° of allowed movement and allowing the barrier to be folded for stacking. The barriers can be used as temporary walls or panels, room dividers of various heights, as room liners for safety and sound or as panels in other uses, such as study carrels.

Figure 12A:
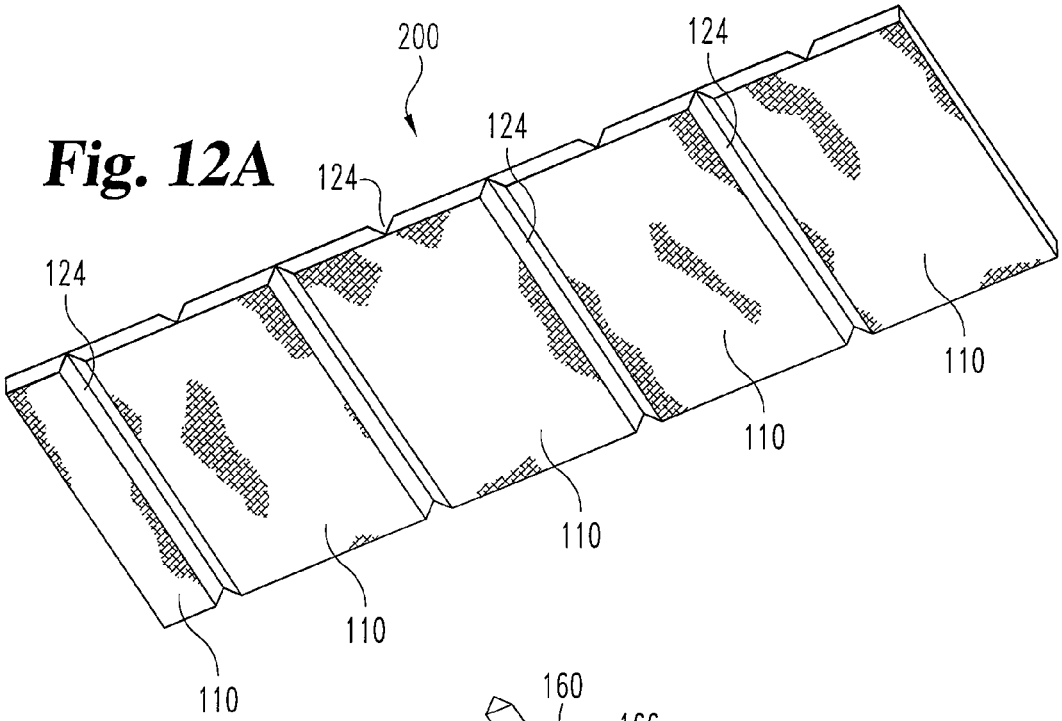
FIG. 12A is a perspective view of a barrier in one embodiment.

A further embodiment of a barrier 200 is illustrated in FIG. 12A. Barrier 200 includes several wall segments 110, separated by grooves 124. Wall segments 110 and grooves 124 are made as described for barrier 100. Preferably barrier 200 includes alternating laterally offset grooves 124 on opposing sides of the barrier. Alternating grooves 124 allow barrier 200 to be more easily bent into corners in alternate directions. Alternating grooves 124 also provide a double width between apparent grooves on one side while concealing grooves on the alternate side.

Figure 12B:
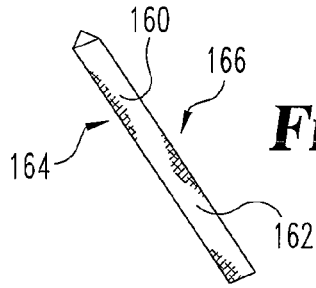
FIG. 12B is a perspective view of a groove insert.

FIG. 12B illustrates one embodiment of a groove insert 160. In this embodiment, groove insert 160 has a triangular cross-section including an outer surface 162 and two inner surfaces 164 and 166. In one embodiment the groove insert is sized and configured to match a triangular cross-section profile of a groove 124 in barrier 200 when the adjacent wall portions are substantially straight or flat. The outer surface 162 of the insert is preferably flush with the surfaces of the adjacent wall portions 110, or alternately can be recessed or protrude. Insert 160 may provide additional strength to the barrier and/or may assist to provide a smooth exterior. The outer surface 162 may be decorated or color coordinated as desired. A triangle is shown as one preferred shape, other cross-sectional shapes may be used as desired to match groove cross-sections in particular shapes or arrangements.

Figure 13:
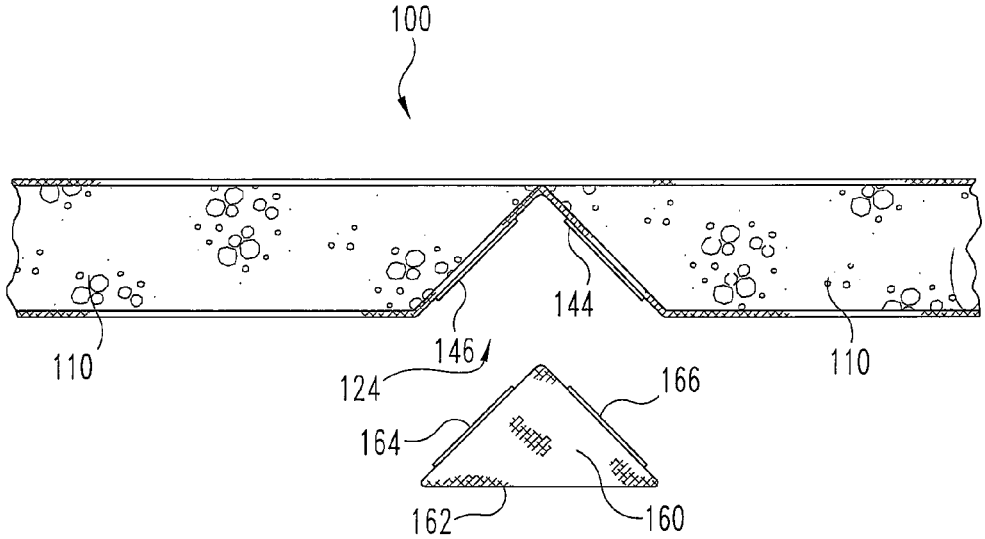
FIG. 13 is a top view of an alternate barrier portion and groove insert.
Figure 14:
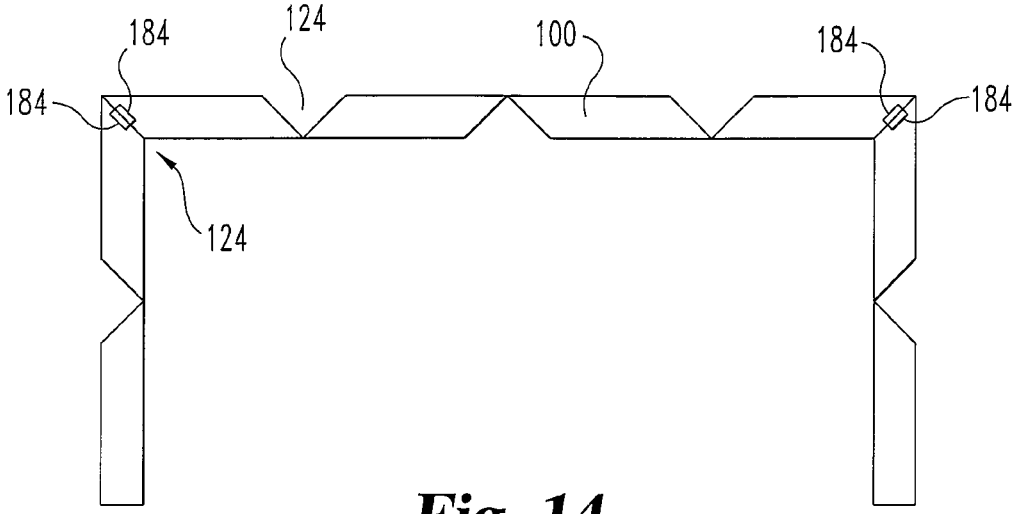
FIG. 14 is a top view of a barrier portion according to a preferred embodiment of the present invention.

FIG. 13 illustrates one method of attaching a groove insert 160 to a groove 124. Mounted on the inner surfaces of groove 124 are a pair of Velcro® hook and loop fasteners 144 and 146. Corresponding hook and loop fastener portions are mounted to the inner surfaces 164 and 166 of insert 160. When insert 160 is placed in groove 124, the hook and loop fasteners mate to releaseably secure insert 160 in groove 124. Alternately, hook and loop fasteners 144 and 146 in groove 124 may connect to each other when the barrier is bent into a corner shape to retain the barrier in the bent configuration. The hook and loop fasteners may be vertical tape, strips or segments along the height of the barrier and/or insert. In one embodiment, one portion of the fasteners is formed by the cover which may, for example, form the loop portions. An alternate connector to hook and loop fasteners would be pairs of magnets 184 mounted to or within the barrier 100 and insert (FIG. 14).

Figure 15:
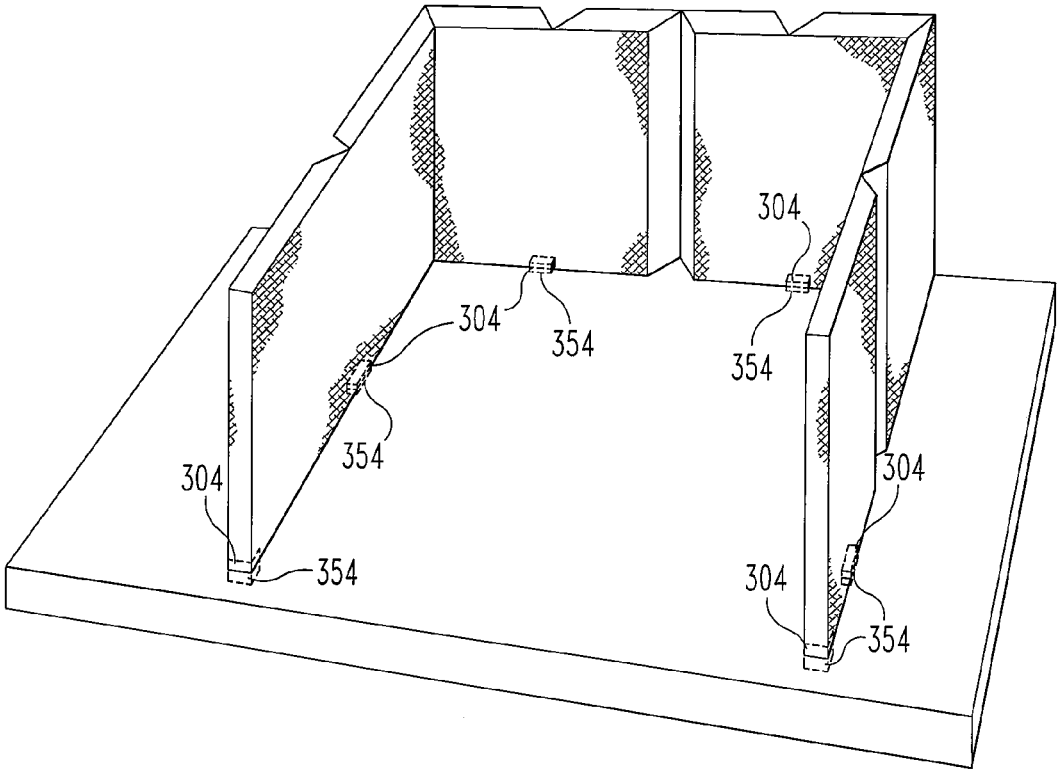
FIG. 15 is a perspective view of a barrier portion according to an alternate preferred embodiment of the present invention.

In one preferred use, the barrier can be mounted on a surface, such as a table to form a study carrel. Illustrated in FIG. 15 is barrier 300 mounted on table 350. Barrier 300 can be made similarly to barrier 100 discussed above. In one feature, barrier 300 may be releasably attachable to the support surface, such as using magnets 304 within the edges of barrier 300 which align and attach to adjacent magnets 354 recessed or embedded in table 350. Alternately, magnets along the top, bottom or side edges of barrier 300 can attach to magnets in additional barriers.

In a further optional feature, the barrier covering material may be decorated with scenes or murals. In one embodiment, the material allows for interactive play, for example with playing characters which releaseably adhere to the barrier by hook and loop fasteners or magnets.

Figure 16B:
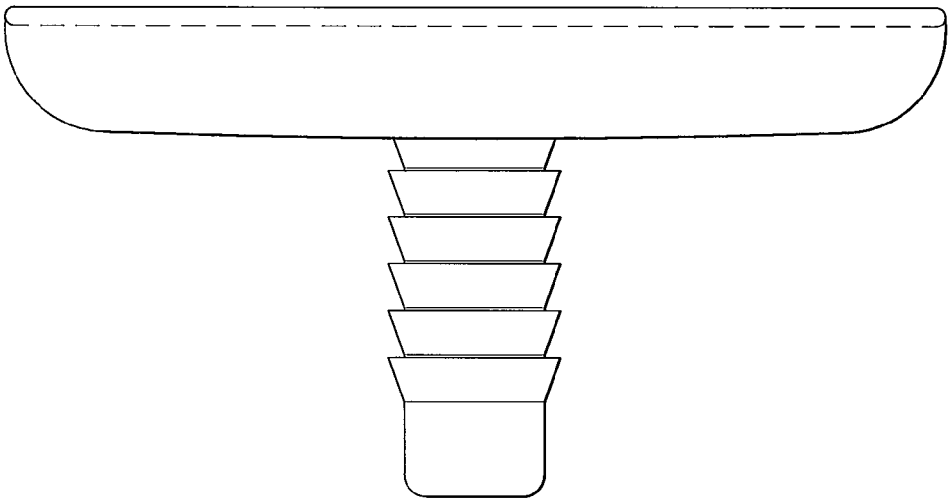
Fig. 16B (PRIOR ART)
FIGS. 16A & 16B are end and side views of a prior art panel glide.
Figure 16A:
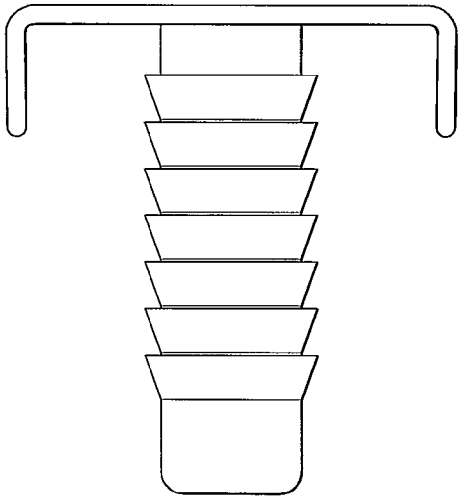
Fig. 16A (PRIOR ART)
Figure 17B:
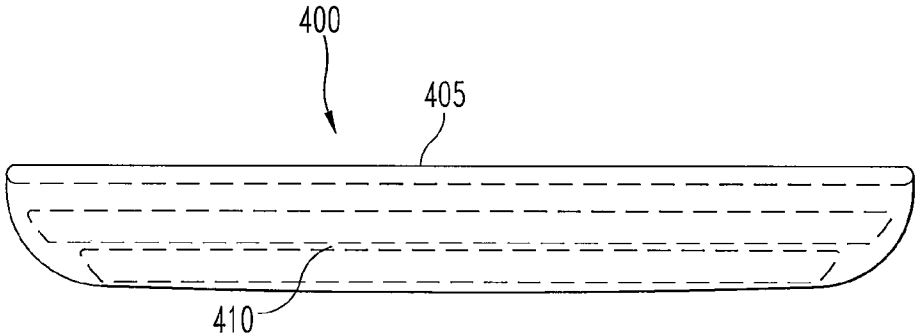
FIGS. 17A & 17B are end and side views of a panel glide according to a preferred embodiment of the present invention.
Figure 17A:
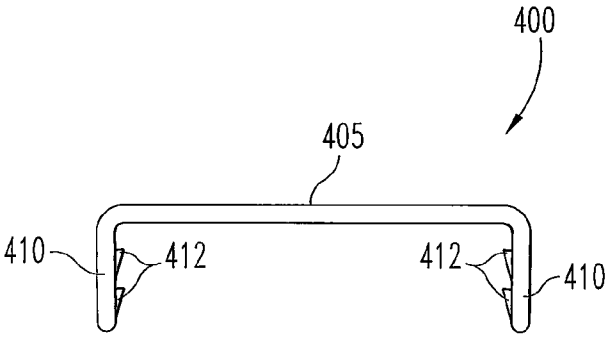

FIGS. 16A & 16B illustrate a prior art glide 390. Prior glide 390 could be mounted to a panel by boring a hole into the panel and inserting the retaining post. The side walls would cover the panel edge corners. An improved panel glide 400 is illustrated in FIGS. 17A & 17B. Panel glide 400 includes a base portion 405, side walls 410 and retaining members, such as tangs or teeth 412. Tangs 412 preferably protrude from the side walls and define at least one tooth or hood which engages the barrier side, preferably by holding to the cover. Preferably tangs 412 do not damage the cover or barrier and are releasably engagable. Tangs 412 may partially or completely penetrate the cover material.

Base portion 405 and side walls 410 define an open and unobstructed channel which can be placed over a barrier edge at any location. Preferably glide 400 is sized to be placed over a top, bottom or side edge of a barrier described herein. The inner face of base portion 405 of glide 400 is preferably placed flush against the barrier edge, with the side walls 410 extending over corner edges onto the flat side panels of the barrier. Preferably glide 400 protects the barrier material and is suitably durable, for example made of plastic, to minimize scuffing, dragging, unraveling, tearing, pulling or other damage to the barrier material.

In one embodiment, glide 400 preferably has a length substantially equal to the width of a wall portion and slightly less than the distance between laterally adjacent hinge portions on the same or opposite sides of the barrier, such that glide 400 does not inhibit operation of the hinges. Alternately, glide 400 has a length sufficient to cross or can be placed across a hinge portion to retain adjacent wall portions in a fixed arrangement such as flat. As an option, a glide can form a bracket for a corner at a desired angle, such as 90 degrees.

Glide 400 can be manually applied along any edge of the barrier at any location, preferably without tools and without damage to the barrier, and is held in place by friction and when the retaining members engage the barrier material. Glide 400 can be removed when desired, by flexing side walls 410 away from the barrier material to disengage the retaining members, and then moving glide 400 away from the barrier.

For purposes of illustration, an example size of glide 400 can have a base portion sized at 3.875"×2.355", with side walls having a height of approximately 1.0". Glide 400 can be made of resilient plastic with the top and side walls approximately 0.125" thick. In one preferred embodiment, the retaining members are two continuous or serried rows of tangs mounted on the insides of the side walls at distances of approximately 0.375" and 0.687" below the inside surface of base portion 405. Preferably the retaining members have a angled entry edge to facilitate mounting glide 400, with an opposing flat or hooked edge to impede unintended removal. In a preferred embodiment, the side walls 410 are biased to slant symmetrically inward from the edges of top 405, for example at an angle of approximately 82.5 degrees.

Figure 18:
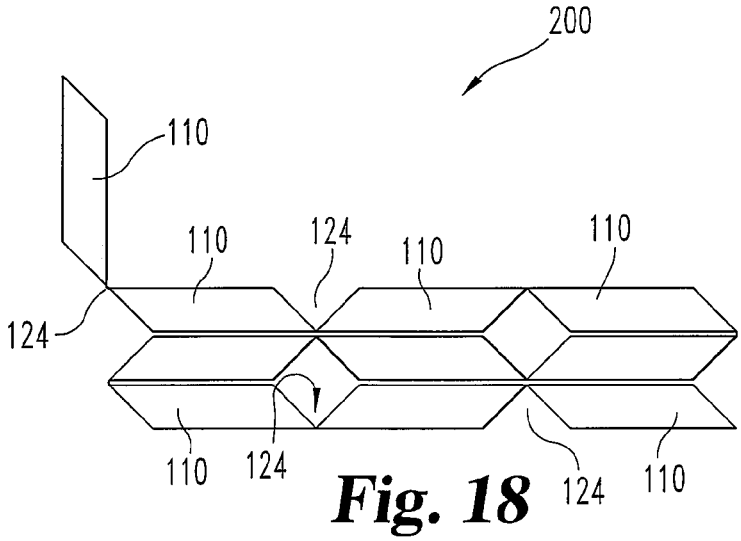
FIG. 18 is an end elevation illustrating an arrangement of a stacked site and sound barrier.

FIG. 18 illustrates one arrangement of a stacked barrier. Optionally, selected hinge portions 124 are bent approximately 180 degrees, to allow wall segments 110 to be stacked in a flat arrangement.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A sight and sound barrier, comprising:

a. a lightweight, resilient foam core possessing cushioning and sound absorbing properties;

b. a plurality of grooves formed in said foam core to define alternating wall and hinge portions in said foam core;

c. a fabric cover with sound absorbing properties adhered to said foam core over said wall and hinge portions; and, d. wherein said grooves have a depth substantially equal to the thickness of said foam core and encompass an angle of approximately ninety degrees;

e. wherein at least one of said grooves defines a substantially triangular cross-section; and, f. at least one hinge insert having a cross-section substantially matching the at least one triangular groove cross-section.

2. The barrier of claim 1, wherein the foam core has two wall sides, and wherein grooves are formed on both wall sides of said foam core.

3. The barrier of claim 2, wherein said grooves on one side of the foam core are laterally offset from the grooves on the second side of the foam core.

4. The barrier of claim 2, wherein said grooves are formed on alternating sides of said foam core along the length of said foam core.

5. The barrier of claim 1, wherein said barrier defines a bottom edge to support the barrier on a support surface and at least one side edge perpendicular to the support surface, wherein said side edge is releasably attachable to a side edge of a second barrier.

6. The barrier of claim 5, wherein said side edge is releasably attachable to a second barrier with magnets.

7. The barrier of claim 6, wherein said magnets are embedded in at least one of said side edge and a side edge of the second barrier.

8. A sight and sound barrier, comprising:

a. a lightweight resilient foam core possessing cushioning and sound absorbing properties and having at least two sides;

b. at least one groove formed in one side of said foam core to define at least two wall portions and at least one hinge portion;

c. a fabric cover with sound absorbing properties adhered to said foam core over said wall and into said hinge portions;

d. wherein said groove encompasses an angle of approximately ninety degrees, allowing said wall portions to be bent into a corner of approximately ninety degrees in a first direction;

e. at least a second groove formed on an opposing side of said foam core from said one side, wherein said second groove encompasses an angle of approximately ninety degrees, allowing said wall portions to be bent into a corner of approximately ninety degrees in a second direction;

f. wherein said grooves have a depth substantially equal to the thickness of said foam core; and, g. said cover adhered to a hinge portion on one side of the barrier touches the cover adhered to a wall portion on the opposing side of the barrier at the deepest point of the hinge portion.

9. The barrier of claim 8 wherein said groove allows said wall portions to be bent approximately 180 degrees in a second direction.

10. A sight and sound barrier, comprising:

a. a plurality of adjacent lightweight, resilient foam core sections possessing cushioning and sound absorbing properties defining a barrier with opposing sides and forming a plurality of discrete wall portions; and, b. a plurality of hinge portions between said core sections;

c. a continuous fabric cover with sound absorbing properties on each side of said barrier along a portion adhered to and covering said wall portions and extending into and across said hinge portions;

d. wherein said hinge portions are formed as a plurality of grooves between adjacent wall portions and wherein each groove encompasses an angle of approximately ninety degrees; and, e. wherein the cover in each hinge portion on one side of the barrier touches the cover on a wall portion on the opposing side of the barrier; and, f. a glide mountable along an edge of said barrier;

g. wherein said barrier is releasably attachable to an elevated support surface with at least one pair of fasteners; wherein one fastener from said pair is recessed or embedded in said barrier and the matching fastener from said pair is recessed or embedded in the support surface.

11. The barrier of claim 10, wherein said grooves are mitered, allowing said wall portions to be bent into a corner of approximately ninety degrees in a first direction.

12. The barrier of claim 11, comprising a pair of fasteners mounted in at least one of said grooves, wherein said fasteners are selectively securable to hold said barrier in said corner shape.

13. The barrier of claim 10, wherein said grooves allow said wall portions to be bent at an angle of approximately 180 degrees in a second direction.

14. The barrier of claim 13, wherein the length of said barrier is stackable by folding selected grooves at 180 degrees in alternating directions.

15. The barrier of claim 10, wherein at least one of said grooves defines a substantially triangular cross-section.

16. The barrier of claim 15, comprising at least one hinge insert having a cross-section substantially matching the at least one triangular groove cross-section.

17. The barrier of claim 16, wherein said hinge insert is selectively mountable in said at least one triangular cross-sectioned groove.

18. The barrier of claim 17, wherein two inner sides of said hinge insert are selectively mountable to matching sides in said at least one triangular cross-sectioned groove with two matched pairs of fasteners, with one fastener of each pair mounted to one side of said hinge and the other fastener of each pair mounted to a matching side of said hinge insert.

19. The barrier of claim 18, wherein the two fasteners mounted in said hinge are selectively securable to each other to hold said barrier in a corner shape.

20. The barrier of claim 18, wherein said fasteners are chosen from hook and loop fasteners or magnets.

21. The barrier of claim 17, wherein said hinge insert is selectively mountable in said at least one triangular groove with an outer face of said hinge insert substantially flush between adjacent wall portions.

22. The barrier of claim 10, wherein said glide is formed of a base portion to be placed against said barrier edge and side walls to extend on opposing sides of said barrier.

23. The barrier of claim 22, wherein said glide includes retaining tangs on said side walls, wherein said tangs are arranged to engage said barrier cover to inhibit removal of said glide.

24. The barrier of claim 23, wherein said retaining tangs have an angled entry edge to facilitate placement of the guide on the barrier edge.

25. The barrier of claim 23, wherein the side walls of said glide are biased to slant inward.

26. The barrier of claim 10, wherein said at least on pair of fasteners are magnets.

* * * * *